US007988385B2

(12) United States Patent
Pallini et al.

(10) Patent No.: US 7,988,385 B2
(45) **Date of Patent: *Aug. 2, 2011**

(54) RAM STYLE TENSIONER WITH FIXED CONDUCTOR AND FLOATING FRAME

(75) Inventors: Joseph W. Pallini, Tomball, TX (US); Edward A. Mendoza, Houston, TX (US)

(73) Assignee: Vetro Gray Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/827,962

(22) Filed: Jun. 30, 2010

(65) Prior Publication Data

US 2010/0260556 A1 Oct. 14, 2010

Related U.S. Application Data

(63) Continuation of application No. 12/629,704, filed on Dec. 2, 2009.

(51) Int. Cl.
*E21B 19/00* (2006.01)

(52) U.S. Cl. ..... 405/224.4

(58) Field of Classification Search ..... 405/224.4, 405/224.3, 224.2, 223.1, 224, 195.1; 166/367
See application file for complete search history.

(56) References Cited

U.S. PATENT DOCUMENTS

| | | | | |
|---|---|---|---|---|
| 4,100,752 | A | 7/1978 | Tucker | |
| 4,787,778 | A | 11/1988 | Myers | |
| 5,069,488 | A | 12/1991 | Freyer | |
| 5,366,324 | A | 11/1994 | Arlt | |
| 5,551,803 | A | 9/1996 | Pallini, Jr. | |
| 6,746,182 | B2 | 6/2004 | Mark et al. | |
| 7,112,011 | B2 | 9/2006 | McCarty | |
| 7,217,067 | B2 | 5/2007 | Mao | |
| 7,329,070 | B1 | 2/2008 | Trent | |
| 7,334,967 | B2 | 2/2008 | Blakseth | |
| 7,632,044 | B2 * | 12/2009 | Pallini et al. | 405/224.4 |
| 7,708,498 | B2 | 5/2010 | Ellis | |
| 2005/0074296 | A1 | 4/2005 | McCarty | |
| 2005/0123359 | A1 * | 6/2005 | McCarty et al. | 405/224.4 |
| 2005/0129464 | A1 | 6/2005 | Moncus | |
| 2005/0147473 | A1 | 7/2005 | Pallini | |
| 2007/0048094 | A1 * | 3/2007 | Mao et al. | 405/224.4 |
| 2008/0205992 | A1 * | 8/2008 | Ellis et al. | 405/224.4 |

FOREIGN PATENT DOCUMENTS

| | | | |
|---|---|---|---|
| EP | 0088608 | A2 | 9/1983 |
| EP | 0088608 | A3 | 7/1984 |

* cited by examiner

*Primary Examiner* — Frederick L Lagman
(74) *Attorney, Agent, or Firm* — Bracewell & Giulian

(57) ABSTRACT

A riser tensioner for an offshore floating platform has a frame stationarily mounted to the upper portion of the riser. Pistons and cylinders are spaced circumferentially around the riser and connected between the frame and the floating platform. A tubular guide member is mounted to the floating platform for movement in unison in response to waves and currents. The riser extends through the guide member. A guide roller support is mounted to and extends downward from the frame around the guide member. At least one set of guide rollers is mounted to the guide roller support in rolling engagement with the guide member as the guide member moves in unison with the platform.

15 Claims, 3 Drawing Sheets

RAM STYLE TENSIONER WITH FIXED CONDUCTOR AND FLOATING FRAME

CROSS-REFERENCE TO RELATED APPLICATION

This application is a continuation of Ser. No. 12/629,704, filed Dec. 2, 2009, which is a continuation of Ser. No. 11/970,974, filed Jan. 8, 2008, now U.S. Pat. No. 7,632,044 which claims priority to provisional patent application Ser. No. 60/879,275, filed Jan. 8, 2007.

FIELD OF THE INVENTION

This invention relates generally to tensioner assemblies and in particular to a riser tensioner assembly associated with a riser extending from subsea well equipment to a floating platform.

BACKGROUND OF THE INVENTION

A floating production platform is often used for deep water offshore oil and gas production. One or more risers extend from subsea equipment on the sea floor, such as a manifold or subsea production tree. The riser extends through an opening in the platform. A riser tensioner is mounted on the platform to apply and maintain tension in the riser.

The tensioner typically comprises a plurality of pistons and cylinders mounted between the platform and a frame secured to the riser. Fluid pressure is applied to the cylinders to apply tension to the riser. The platform moves toward and away from the subsea equipment in response to waves and currents. The riser, of course, is relatively stationary at the surface, so the movement of the platform causes the pistons and cylinders to stroke inward and outward.

To avoid damage to the riser due to platform movement, guide rollers may be employed to engage the riser or a conductor pipe surrounding an upper portion of the riser. The guide rollers are typically mounted to the platform for movement in unison with the platform.

SUMMARY

The riser tensioner has a frame stationarily mounted to the upper portion of the riser. A plurality of pistons and cylinders are mounted between the frame and the floating platform. The cylinders are supplied with a pressurized fluid to apply tension to the riser. A guide member is mounted to the floating platform for movement in unison in response to waves and currents. A bearing support is stationarily mounted to and extending from the frame. A bearing is mounted to the bearing support in movable engagement with the guide member as the guide member moves in unison with the platform. In the preferred embodiment, the bearing comprises a set of rollers. The guide member and the guide roller or bearing support are in telescoping relation ship with one another.

In the embodiment shown, the guide member is tubular, and the riser extends through the guide member. In this embodiment, the platform has an upper deck and a lower deck. The piston and cylinders are mounted to the upper deck. The guide member is mounted to the lower deck and extends upward through an opening in the upper deck.

DETAILED DESCRIPTION OF THE INVENTION

Figure 1:
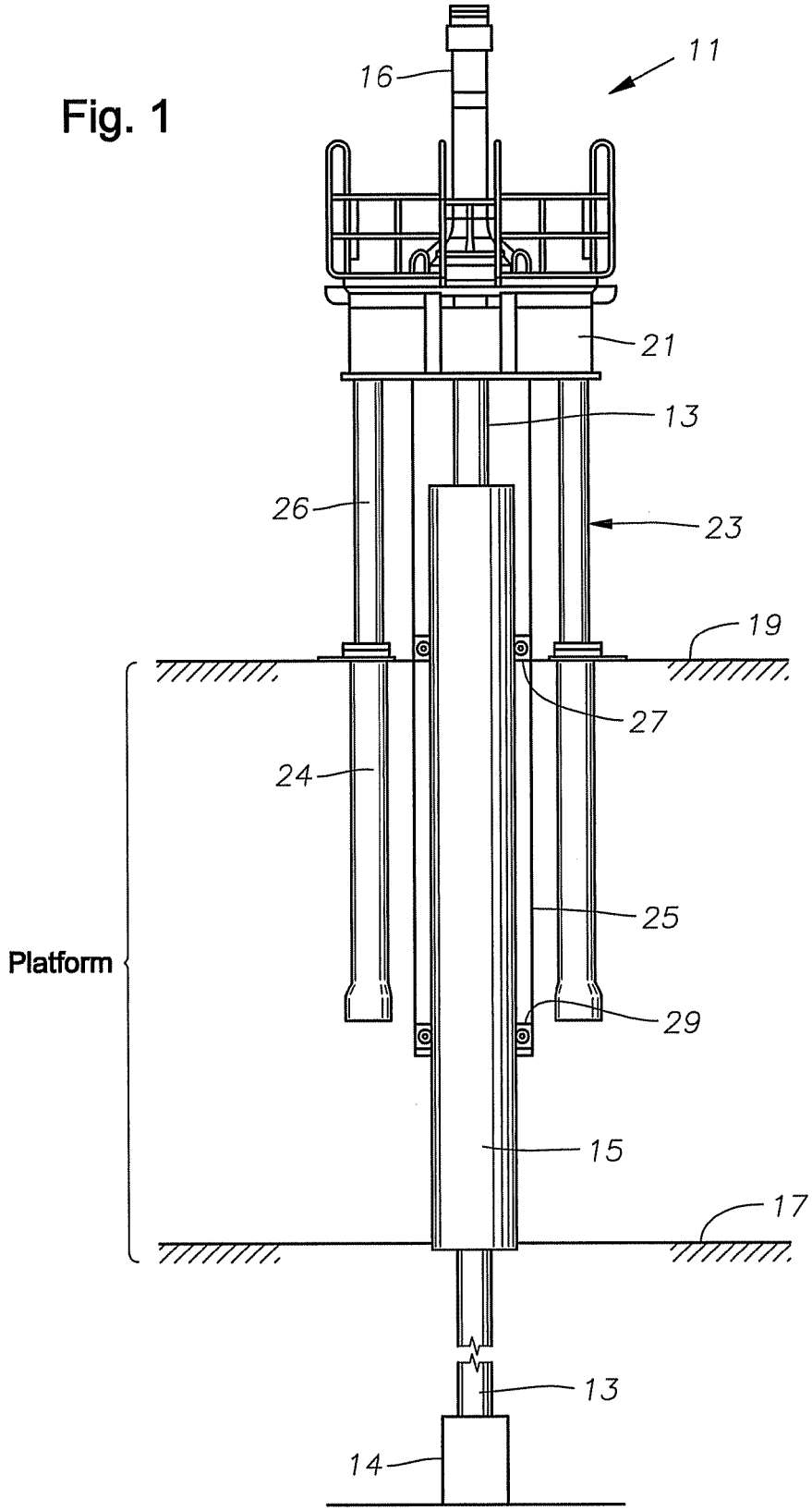
FIG. 1 is a schematic view of a riser tensioner assembly, built in accordance with the present invention, and in an intermediate position.

Referring to FIG. 1, a riser tensioner assembly 11 is associated with a riser 13 extending between subsea well equipment 14 on the sea floor and a floating production facility or platform at the surface. The subsea well equipment 14 may be a subsea wellhead, production tree, manifold or other facilities for conveying well fluids to the floating production facility. The lower end of riser 13 is stationarily mounted to subsea well equipment 14. Riser 13 is fixed in length and extends upward from subsea well equipment 14 through an opening in the floating platform.

In this embodiment, riser 13 extends through a conductor or guide member 15 mounted stationarily on the production facility. Guide member 15 is preferably tubular and has an inner diameter larger than an outer diameter of riser 13. Riser 13 extends above guide member 15 to a riser mandrel 16 for interfacing with equipment on the production facility. The lower end of guide member 15 may be located at the bottom of the floating production facility.

The platform preferably includes a lower deck 17 that is rigidly connected to guide member 15 such that guide member 15 is stationary relative to lower deck 17 and the rest of the platform. The platform also has an upper deck 19 that is a fixed distance from lower deck 17. In this example, upper deck 19 serves as a base for riser tensioner assembly 11 to actuate from.

Figure 2:
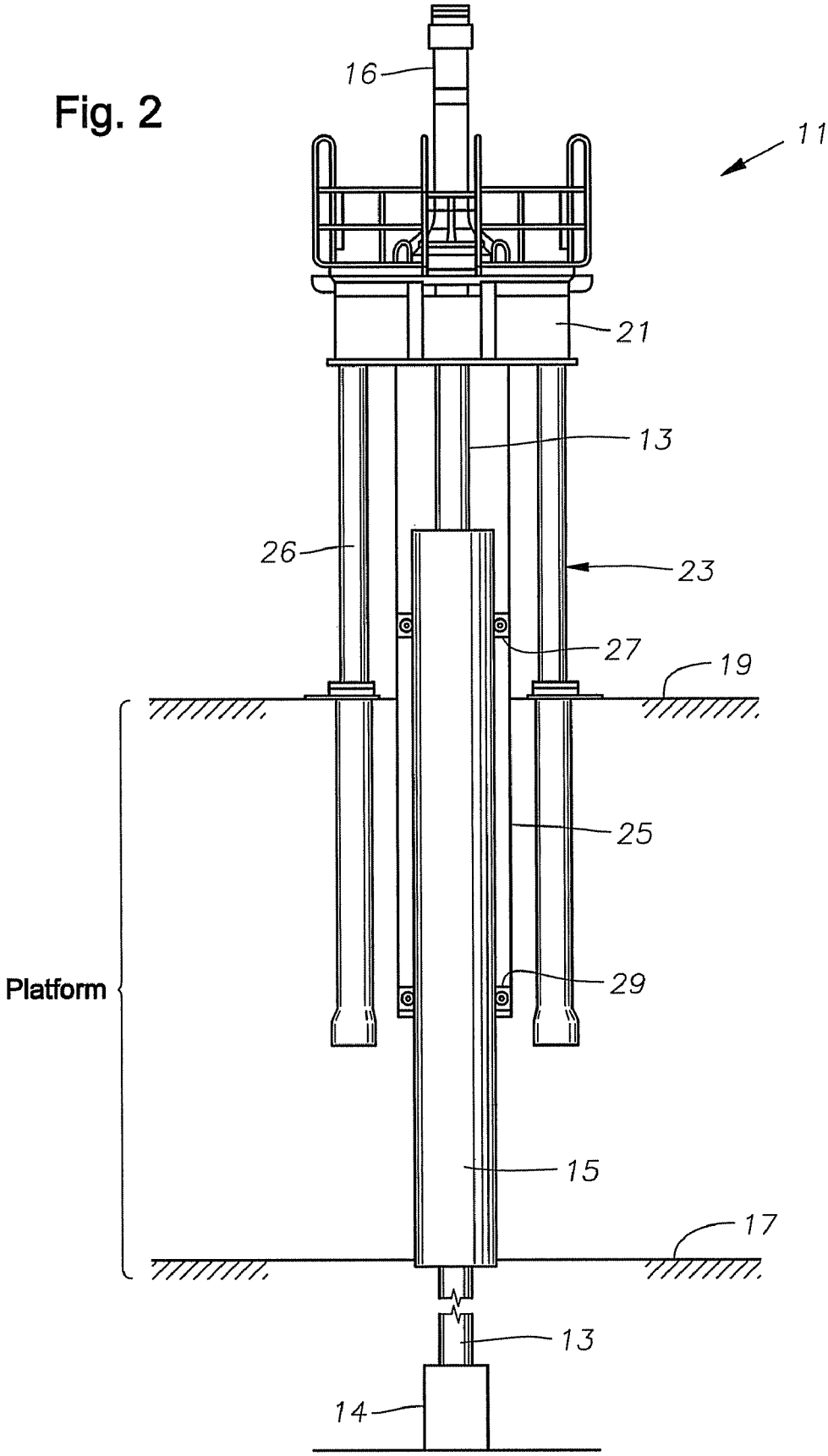
FIG. 2 is a schematic view of the riser tensioner assembly of FIG. 1, in an extended position.
Figure 3:
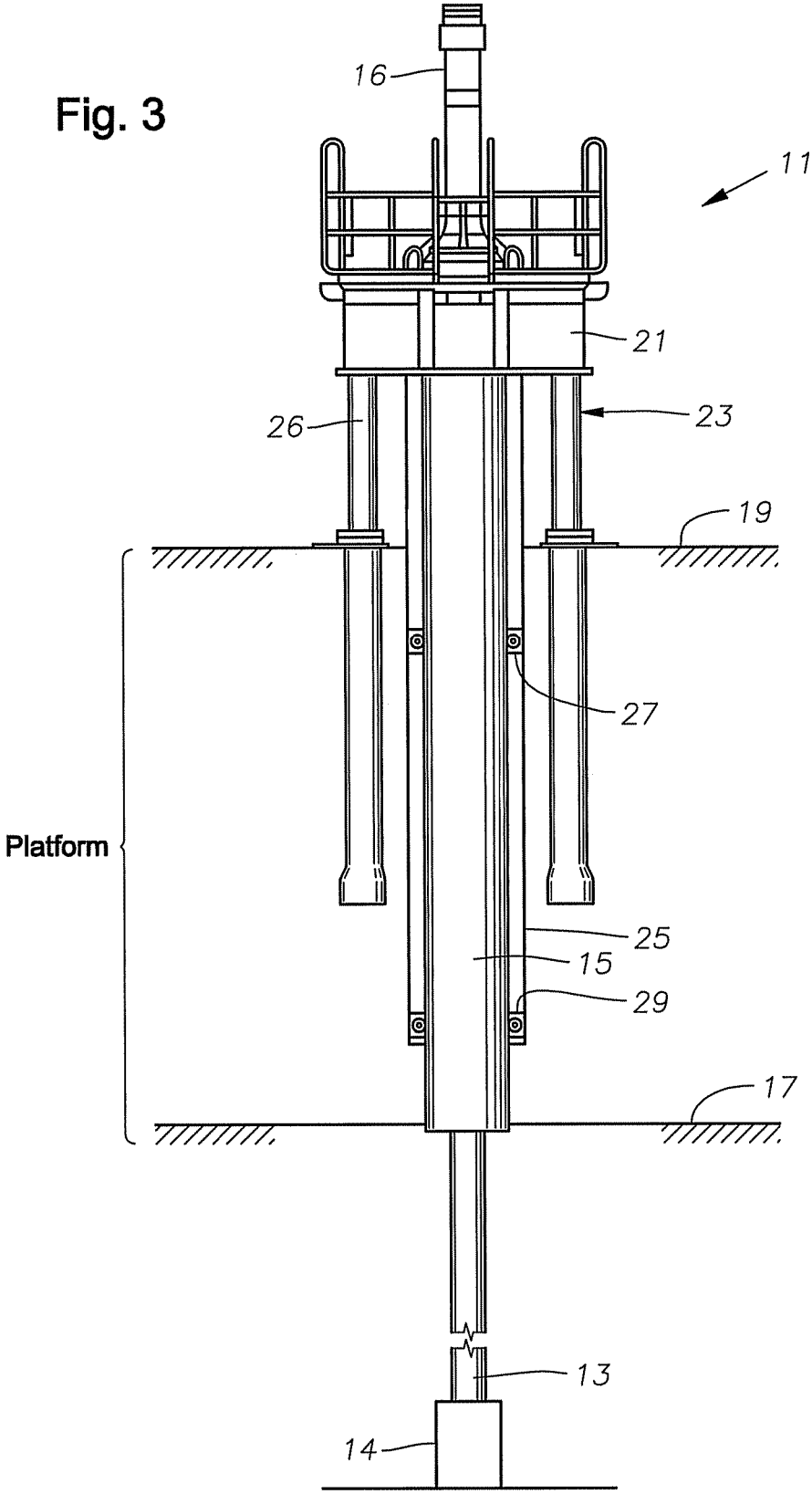
FIG. 3 is a schematic view of the riser tensioner assembly of FIG. 1, in a retracted position.

Riser tensioner assembly 11 preferably includes a top frame 21 positioned above upper deck 19 and stationarily mounted to riser mandrel 16. A plurality of hydro-pneumatic cylinder assemblies 23 extend axially downward from frame 21 and connect to upper deck 19. In the preferred embodiment, cylinder assemblies 23 are circumferentially spaced around riser 13. Each cylinder assembly 23 comprises a cylinder or cylinder 24 and a piston 26 such that cylinder assemblies 23 actuate between an extended position as shown in FIG. 2 and a retracted position as shown in FIG. 3. Preferably each cylinder 24 is mounted stationarily to upper deck 19 and the upper end of each piston 26 is mounted to frame 21. However, that arrangement could be reversed. Cylinder assemblies 23 exert an upward tensile force on riser 13 and help to alleviate changes in axial loads on riser 13 due to movement of the production facility toward and away from subsea equipment 14 in response to waves and currents.

A guide roller or bearing support 25 extends downward from frame 21 around an upper portion of guide member 15. In the example shown, guide roller support 25 comprises frame members or braces spaced circumferentially apart from each other. Each brace extends parallel with an axis of guide member 15. Alternately, guide roller support could be tubular in order to receive and surround a portion of guide member 15. Guide roller support 25 has a lower end that is spaced above the lower end of guide member 15, even during a minimum stroke position, as shown in FIG. 3. Guide roller support 25 is rigidly connected to frame 21 such that guide roller support 25 is stationary with frame 21 and riser 13. Decks 17, 19 and guide member 15 move axially upward and downward relative to guide roller support 25.

Upper and lower bearings 27, 29 are mounted to guide roller support 25 for rolling engagement with the exterior of guide member 15. Each bearing is preferably a set of rollers 27, 29, which comprises a plurality of rollers spaced circumferentially around guide member 15. Upper and lower rollers 27, 29 aid in the movement of guide member 15 relative to guide roller support 25 as guide member 15 moves axially upward and downward relative to guide roller support 25. In the preferred embodiment, rollers 27, 29 are axially spaced apart and mounted on the inner side of guide member 15. Axially spacing apart rollers 27, 29 helps to distribute forces from guide member 15 to guide roller support 25 so that riser tensioner assembly 11 transfers moment forces associated with movements of the production facility through guide member 15 and guide roller support 25 rather than directly to riser 13.

FIG. 1 shows tension assembly 11 in an intermediate position, with pistons 26 partly extended and frame 21 spaced above the upper end of guide member 15. In FIG. 2, the production vessel has moved downward or closer to the subsea well equipment 14 from the position in FIG. 1. Because riser mandrel 16 is stationary, pistons 26 have extended from the position in FIG. 1. The upper end of guide member 15 is farther from frame 21 than in FIG. 1. The upper end of guide member 15 is closer to the upper set of rollers 27 than in FIG. 1.

In FIG. 3, the production vessel has moved farther from the subsea well equipment 14 due to waves or current. Pistons 26 have contracted and the upper end of guide member 15 is substantially in contact with frame 21. Guide member 15 has moved upward such that the lower set of rollers 29 is now engaging guide member 15 near its lower end.

Although some embodiments of the present invention have been described in detail, it should be understood that various changes, substitutions, and alterations can be made hereupon without departing from the principle and scope of the invention. For example, rather than guide rollers to serve as the bearings, bushings could be used. Also, rather than a single, central guide member that receives the riser, a plurality of offset guide members could be employed. These offset guide members would not receive a riser, rather they would be mounted circumferentially around the riser, such as between some of the cylinder assemblies. A mating upper guide roller set would be mounted to the top frame for each offset guide member. In that instance the offset guide members would extend through the upper end of the top frame.

The invention claimed is:

1. A riser tensioning system for applying tension to a riser extending from subsea equipment to a surface platform, comprising:

a first member coupleable to the riser to enable a force applied to the first member to be transferred to the riser;

a plurality of cylinder assemblies configured to be secured to the surface platform around the riser, each of the plurality of cylinder assemblies comprising a piston partially housed within a cylinder, the cylinder assemblies being coupleable at one end to the first member to enable pressure within the plurality of cylinder assemblies to exert an upward tensile force on the riser to alleviate changes in axial loads on the riser due to movement of the surface platform toward and away from the subsea equipment;

a guide member securable to the surface platform to guide movement of the first member relative to the surface platform; and a plurality of rollers securable to the first member to enable the first member to roll along a length of the guide member.

2. The riser tensioning system as recited in claim 1, wherein each of the plurality of cylinder assemblies is a hydro-pneumatic cylinder assembly.

3. The riser tensioning system as recited in claim 1, wherein the platform has upper and lower decks, and the guide member is mounted to the lower deck and extends upward to the upper deck.

4. The riser tensioning system as recited in claim 1, wherein the plurality of rollers comprises a first roller and a second roller, the second roller being displaced axially relative to the first roller.

5. The riser tensioning system as recited in claim 1, wherein the plurality of rollers comprises a first roller and a second roller, the second roller being displaced laterally around the guide member relative to the first roller.

6. The riser tensioning system as recited in claim 1, wherein the plurality of rollers are displaced axially and laterally relative to the guide member.

7. An offshore facility having a floating platform, a riser having a lower end secured to subsea equipment and an upper portion at the platform, an improved riser tensioner, comprising:

a frame stationarily mounted to the upper portion of the riser;

a plurality of pistons and cylinders, each piston and cylinder being mounted between the frame and the floating platform, the cylinders being supplied with a pressurized fluid to apply tension to the riser;

a guide member mounted to the floating platform for movement in unison in response to waves and currents; and at least one set of rollers carried by the frame and in rolling engagement with the guide member as the guide member moves in unison with the platform.

8. The facility according to claim 7, wherein:

the guide member is an elongated tubular member.

9. The facility according to claim 7, wherein:

the platform has first and second decks, one spaced above the other;

the piston and cylinders are mounted to the first deck; and the guide member is mounted to the first deck.

10. The facility according to claim 7, wherein the at least one set of guide rollers comprises a plurality of guide rollers positioned at least partially circumferentially around the guide member.

11. The facility according to claim 7, wherein the guide member has an upper end that is below the frame while the piston and cylinders are in minimum stroke positions.

12. The facility according to claim 7, further comprising:

a roller support mounted to and extending from the frame; and wherein the at least one set of rollers is mounted to the roller support.

13. The facility according to claim 7, wherein the at least one set of rollers comprises rollers that are displaced axially and laterally relative to the guide member.

14. The facility according to claim 7, further comprising:

a plurality of elongated braces spaced circumferentially around the guide member and mounted stationarily to the frame; and wherein the at least one set of rollers comprises a roller mounted to each of the elongated braces a fixed distance from the frame.

15. A method for applying tension to a riser extending from a subsea location to a surface platform, comprising:

coupling a first member to the riser to enable a force applied to the first member to be transferred to the riser;

securing a plurality of piston and cylinder assemblies to the surface platform to enable the plurality of piston and cylinder assemblies to provide a force to the first member to maintain the riser in tension;

securing a guide member to the surface platform, the guide member being adapted to guide movement of the first member relative to the surface platform; and coupling at least one roller assembly to the first member to enable the first member to roll along a length of the guide members.

* * * * *